US005154637A

United States Patent [19]

Klug et al.

[11] Patent Number: 5,154,637

[45] Date of Patent: Oct. 13, 1992

[54] HIGH CURRENT CABLE TERMINATION FOR PULSED POWER APPLICATIONS

[75] Inventors: Reja B. Klug, Fort Walton Beach; Richard D. Ford, Shalimar; Keith A. Jamison, Destin; Ronald E. Stearns, Mary Esther, all of Fla.

[73] Assignee: The United States of America as Represented by the Secretary of the Air Force, Washington, D.C.

[21] Appl. No.: 810,253

[22] Filed: Dec. 19, 1991

[51] Int. Cl.[5] ..... H01R 17/04

[52] U.S. Cl. ..... 439/585; 439/801; 439/580

[58] Field of Search ..... 29/828, 862, 864, 867; 174/75 R, 75 C, 84 C, 88 C; 439/578-585, 675, 322, 805, 426, 427, 877-882, 801

[56] References Cited

U.S. PATENT DOCUMENTS

| | | | |
|---|---|---|---|
| 2,959,764 | 11/1960 | Barr | 439/805 |
| 3,923,367 | 12/1975 | Carter | 439/585 |
| 4,131,332 | 12/1978 | Hogendobler et al. | 439/585 |
| 4,445,745 | 5/1984 | Cartesse | 439/585 |
| 4,813,887 | 3/1989 | Capp | 439/585 |
| 5,052,947 | 10/1991 | Brodie et al. | 439/607 |

*Primary Examiner*—David L. Pirlot

*Attorney, Agent, or Firm*—Bernard E. Franz; Donald J. Singer

[57] ABSTRACT

The terminations provide a means for connecting coaxial power cables carrying tens to hundreds of kiloamperes of pulsed current to electrical devices without producing arcing or melting during operation; and also provide mechanical support at cable ends where otherwise unsupported ends would be damaged due to magnetic force acting on current carrying members. To avoid contact arcing (1) the contact supplies mechanical support to the cable at the termination, to prevent magnetic forces from moving the conductor in any direction which would loosen the contact; (2) the connector is installed with sufficient force to meet the a given resistance criterion, and the force is maintained during the expected life of the cable and termination; (3) a smooth, well-defined surface is provided at the surface of the connector where it interfaces with the mating system contact. The mechanical force is provided by use of a hydraulic powered swager which deforms a thick walled connector inward; or by the use of an intense pulsed magnetic force (magnetic swaging) which deforms the conductor inward; or by separating wire bundles and flaring them between two contact surfaces, with contact force provided by use of screws to produce the desired clamping force between two contact surfaces. If hydraulic swaging is used, the deformed conductor is threaded, and a mating threaded sleeve is screwed in place and torqued to high pressure to provide the smooth surface. With magnetic swaging or clamping between two contact surfaces, the connector contact surface remains smooth.

12 Claims, 3 Drawing Sheets

HIGH CURRENT CABLE TERMINATION FOR PULSED POWER APPLICATIONS

RIGHTS OF THE GOVERNMENT

The invention described herein may be manufactured and used by or for the Government of the United States for all governmental purposes without the payment of any royalty.

BACKGROUND OF THE INVENTION

The present invention relates generally to high current cable terminations for pulsed power applications; and more particularly to terminations for a "High Energy Coaxial Cable for Use in Pulsed High Energy Systems", covered by our copending patent application Ser. No. (AF Inv. 19975), filed Dec. 11, 1991, which is hereby incorporated by reference.

The art of making non-arcing contacts is well documented. In a book by R. Holm, "Electric Contacts", Springer-Verlay, on electrical contact design, at page 438, it is pointed out that contact resistance primarily depends on contact pressure and that voltage drop, which equals current through the contact multiplied by contact resistance, must be lower than a critical value. The critical value given for a copper-to-copper contact is volts. Thus, as current increases in a contact, pressure must also increase proportionately.

Previously, when electrical interconnects were at currents of hundreds of kiloamperes, rigid conductors were bolted in place with sufficient force to avoid arcing at contact points. When conventional cables were used, it was necessary that the current path be broken into many parallel paths having relatively low coulomb rating. Current per path is then small relative to total current, and so high resistance and subsequently low contact pressure can be tolerated. Connections may be made for such contacts using techniques including soldering, brazing, or crimping.

SUMMARY OF THE INVENTION

An objective of the invention is to provide a means for connecting power cables carrying tens to hundreds of kiloamperes of pulsed current to electrical devices without producing arcing or melting during operation. A further objective is to provide mechanical support at cable ends where otherwise unsupported ends would be damaged due to magnetic force acting on current carrying members.

At the high current per contact required in the use of the high energy cable, three important design criteria must be met if contact arcing is to be avoided. First, the contact must supply mechanical support to the cable at the termination, to prevent magnetic forces from moving the conductor in any direction which would loosen the contact. Second, the connector must be installed with sufficient force to meet the Holm resistance criterion, and force must be maintained during the expected life of the cable and termination. Third, a smooth, well-defined surface is needed at the surface of the connector where it interfaces with the mating system contact.

During development of the high current flexible cable interface, three different termination assembly techniques were used. Each technique was found to produce satisfactory results and the technique selected for a given installation depended primarily on availability of equipment to accommodate a particular technique.

In one embodiment, the mechanical force is provided by use of an 8-jaw hydraulic powered swager. This tool produces a precise but intense pressure which deforms a thick walled connector inward. To provide a precise, smooth surface, the deformed conductor is threaded, and a mating threaded sleeve is screwed in place and torqued to high pressure. The threaded sleeve has the smooth contact surface.

In a second embodiment, the connector is manufactured to have two different outside diameters. The connector has a large counter bore at the end having the large outer diameter to provide an insulator support region which fits over the inner insulator. The remainder of the connector has a bore the size of the inner conductor. The smaller thin-walled section is designed such that use of an intense pulsed magnetic force (magnetic swaging) deforms the conductor inward, producing the desired high pressure contact, while the larger and thicker portion of the conductor is unaffected by the swaging process and provides the smooth surface.

In another embodiment, connector manufacturing is straightforward and desired contact is provided by separating wire bundles and flaring them between two contact surfaces. Contact force is provided by use of screws to produce the desired clamping force between two contact surfaces. The connector contact surface remains smooth.

The techniques described above are also used to provide support and non-arcing contact at the cable outer conductor.

ADVANTAGES

1. The cable terminations according to the invention utilize large cross-section deformable conductors, along with various techniques for applying force to the conductor and sustain the force, to meet the non-arcing contact criteria described by Holm. It produces a satisfactory termination for a new high energy cable capable of conducting peak currents as great as 200 kiloamperes, with current pulse duration of up to several tens of milliseconds.

2. The cable terminations, while providing hundred kiloampere, millisecond pulse current carrying capability through a pressure contact, also provides mechanical support to resist damage to the cable due to intense magnetic forces at the otherwise unsupported cable terminations.

3. The cable terminations provide a smooth, uniform outer dimension contact surface, after a non-arcing pressure contact has been formed. The uniform dimension surface permits rapid, interchangeable interconnections to pulsed power equipment operating to hundreds of kiloampere peak currents.

DETAILED DESCRIPTION

The invention is disclosed in a paper titled "High Energy Cable Development for Pulsed Power Applications" by Jamison et al in the IEEE Transactions of Magnetics, Vol. 27, No. 1, January 1991, based on an oral presentation at the 5th Symposium on Electromagnetic Launcher Technology, San Destin, Fla., April 1990. The IEEE paper is hereby incorporated by reference.

The three terminal assembly techniques according to the invention, along with detailed design information and test results are described in a technical information memorandum (TIM-1-308) by applicants Ron Stears and Keith Jamison. A technical information memorandum (TIM-1-315) by applicants Ron Stears and Keith Jamison shows improvement in cable termination techniques. Copies of these two technical information memoranda are attached hereto as appendices and are hereby incorporated by reference.

Figure 7:
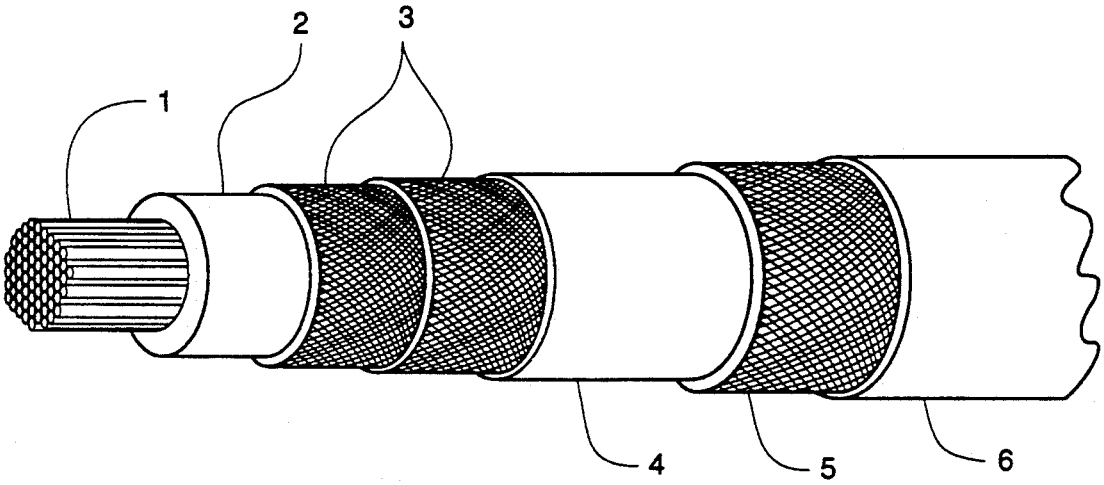
FIG. 7 is a cut-away pictorial view of the cable alone.

The cut-away view of the cable configuration is shown in FIG. 7. The seven elements which comprise the cable are discussed below.

Center Conductor: The center conductor 1 comprised of 1330 30 gauge nickel plated copper strands. In its present configuration it has a nominal diameter of 12.2 mm (0.480 in). The core portion of the strands are counter-wound from the outer strands for improved flexibility. The total cross-sectional area is 68 $mm^2$ (or a current carrying cross-section of 130,000 circular mil area).

Inner Dielectric: The inner dielectric 2 is extruded perfluoroalkoxy, (PFA) TEFLON with a nominal wall thickness of 5.1 mm. The nominal outside diameter is 22.2 mm (0.875 in).

Outer Conductor: The outer conductor 3 is comprised of two counter-wound layers of stranded nickel plated copper wire. Each layer is formed from 48 stranded wires which have been made from nineteen 30-gauge strands. The total cross-sectional area is 93 $mm^2$ (155,000 circular mils).

Outer Dielectric: The outer dielectric 4, made of extruded PFA TEFLON, is utilized to hold the outer conductor in place since it is not braided. It has a nominal wall thickness of 1.6 mm and a nominal outside diameter is 31 mm (1.220 in).

KEVLAR Braid: A reinforcing mesh 5 is woven over the outer dielectric to aid in the containment of the magnetic burst forces. The mesh is manufactured from the arimid fiber KEVLAR.

Outer Jacket: The outer jacket 6 is made of a flame retardant polyether based polyurethane.

At each end of the cable a connector is required for interconnecting the cable to other equipment. This necessitates removal of the insulating material and concurrently the magnetic force containment. As a result, a connector is needed which provides both good electrical contact and mechanical support against magnetic forces.

At the high current per contact required in the use of the high energy cable, three important design criteria must be met, if contact arcing is to be avoided. First, the contact must supply mechanical support to the cable at the termination, to prevent magnetic forces from moving the conductor in any direction which would loosen the contact. Second, the connector must be installed with sufficient force to meet the Holm resistance criteria, and force must be maintained during the expected life of the cable and termination. Third, a smooth, well-defined surface is needed at the surface of the connector where it interfaces with the mating system contact.

The mating system contacts at the power source and at the pulsed power load should have cylindrical holes into which the smooth surfaces of the connector are inserted, and bolted or otherwise fastened to provide high forces.

During development of the high current flexible cable interface, three different termination assembly techniques were used. Each technique was found to produce satisfactory results primarily on availability of equipment to accommodate a particular technique. The parts for the connectors may be of a suitable conductive material, such as copper or brass.

Figure 1:
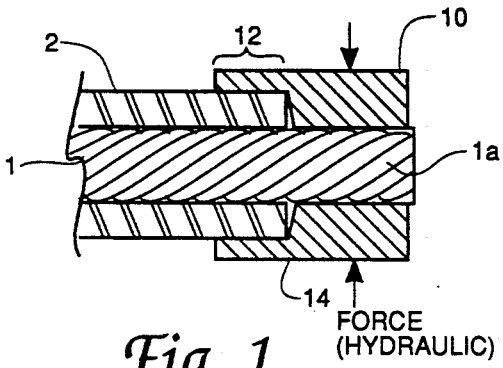
FIGS. 1, 2 and 3 are cross-section views of three embodiments of a cable termination assembly technique, with FIG. 1 showing use of hydraulic force, FIG. 2 showing use of a magnetic swaging force and FIG. 3 showing mechanical force applied with screws.
Figure 2:
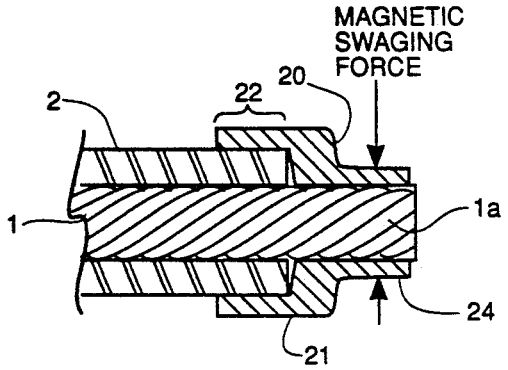
Figure 3:
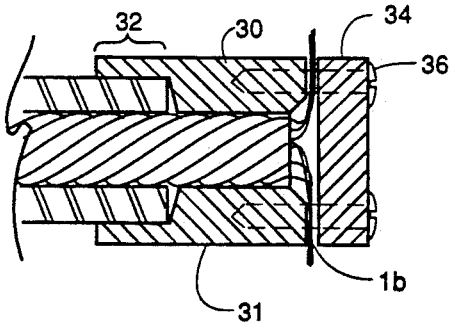

The different techniques are shown in the drawings. Each configuration uses different techniques to meet the first and second design criterion, i.e. to provide mechanical support to the cable and to provide sufficient pressure to maintain the contact at non-arcing pressure. Cable support is provided to the center conductor 1 by counter-boring the connector at a diameter similar to that of the center conductor insulator 2, as shown in FIGS. 1, 2 and 3. In each case, the outer layers 3–6 of the cable are removed at the end, and the insulator 2 is removed for a lesser distance to leave a bare portion 1a of the center conductor. The bare portion of the conductor then passes through a smaller diameter and mechanical force is applied to produce a desired contact pressure.

Figure 4:
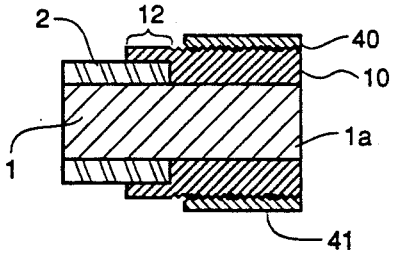
FIG. 4 shows the embodiment of FIG. 1 modified to provide a uniform dimension contact surface.

In the embodiment of FIG. 1, the mechanical force is provided by use of an 8-jaw hydraulic powered swager. This tool produces a precise but intense pressure which deforms a thick walled connector 10 inward. The connector 10 has a counter bore to provide an insulator support region which is fitted over the inner insulator 2. The bare portions 1*a* of the center conductor passes through a smaller diameter. The hydraulic force is then applied to the connector 10 as shown. The final design criterion of a precise, smooth surface then requires that the deformed conductor 10 be threaded, and a mating threaded sleeve 40 be screwed in place and torqued to high pressure as shown in FIG. 4. The threaded sleeve 40 has the smooth contact surface 41. While this technique produces highly desirable results, connector design is complex, and assembly requires the use of specialized hydraulic equipment.

In the embodiment of FIG. 2, the connector 20 is manufactured to have two different outside diameters. The connector 20 has a large counter bore at the end having the large outer diameter to provide an insulator support region 22 which fits over the inner insulator 2. The remainder of the connector has a bore the size of the inner conductor. The smaller thin walled section is designed such that use of an intense pulsed magnetic force (magnetic swaging) deforms the conductor inward, producing the desired high pressure contact, while the larger and thicker portion of the conductor is unaffected by the swaging process and provides the smooth surface 21 defined by design criterion three. This technique simplifies design requirements on the connector and minimizes assembly time, but requires the availability of relatively specialized magnetic swaging equipment.

In the embodiment of FIG. 3, connector manufacturing is straightforward and desired contact is provided by separating wire bundles and flaring them between two contact surfaces. The copper connector 30 is similar to the connector 10 of FIG. 1, but it has screw holes drilled and tapped at the end. A copper clamping plate 34 has screw holes matching those of the connector 30. The inner conductor has the conductor bundles 1b separated and flared to go between the end of the connector 30 and the plate 34. Contact force is provided by use of screws 36 to produce desired clamping force between two contact surfaces. The connector contact surface 31 remains smooth. This technique produces satisfactory results without the use of specialized equipment, but requires considerable assembly time and is more susceptible to failures due to personnel error in assembly.

Figure 5:
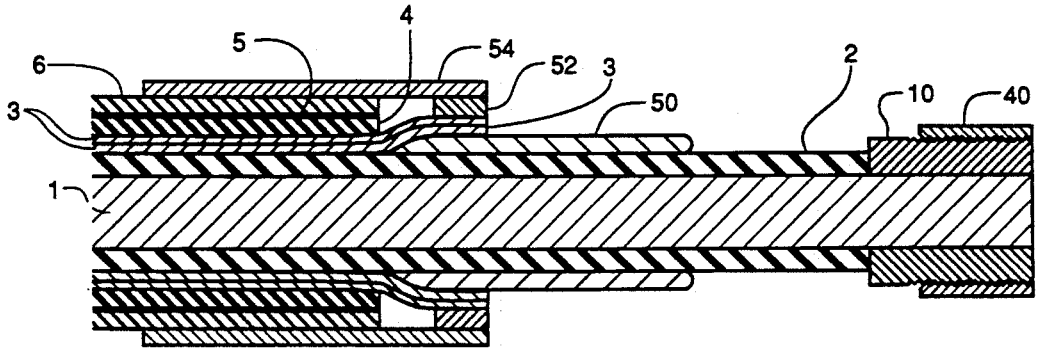
FIG. 5 shows hydraulic swaging terminals for both the center and outer conductors.
Figure 6:
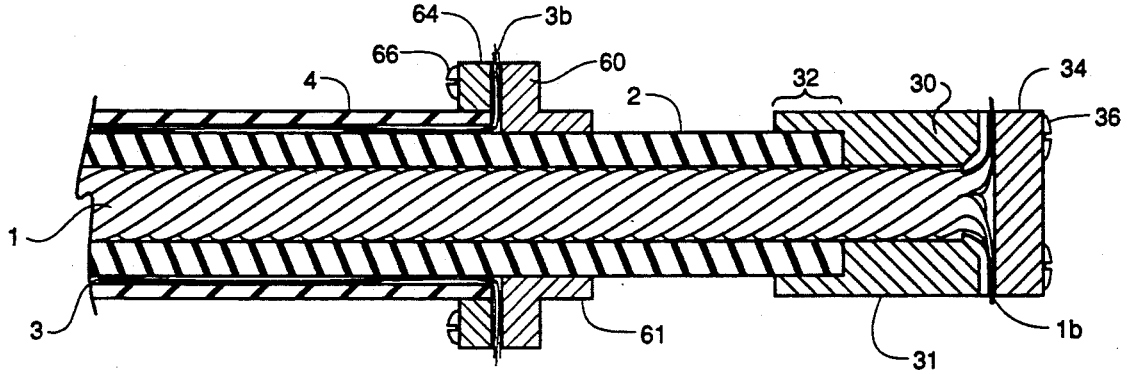
FIG. 6 shows mechanically (screw) clamped terminals for both center and outer contacts.

The techniques described above are also used to provide support and non arcing contact at the cable outer conductor, as shown in FIGS. 5 and 6. FIG. 5 shows the assembly needed for both swaging techniques of FIGS. 1 and 2, while FIG. 6 shows one configuration for the mechanical assembly technique of FIG. 3.

FIG. 5 shows the embodiment of FIGS. 1 and 4 for the termination of the inner conductor (except that the insulator support region is omitted), plus a termination for the outer conductor. The cable comprises the center conductor 1, the inner dielectric 2, the outer conductor 3 (two layers), the outer dielectric 4, the KEVLAR braid 5 and the outer jacket 6, as in FIG. 7.

The basis for attaching connectors to both the inner and outer conductors of the High Power Coaxial Cable (HPCC) is crimping soft copper cylinders over the conductors. Both connection points are $1\frac{1}{8}$ inch right circular cylinders with a spacing of 2.5 inches between the inner and outer connections. Not shown in FIG. 5 is an insulating support sleeve (2 inches in length, $\frac{7}{8}$" ID, $1\frac{1}{8}$" OD) which could be used to cover the exposed inner dielectric and provide additional strength to the cable end.

Figure 5A:
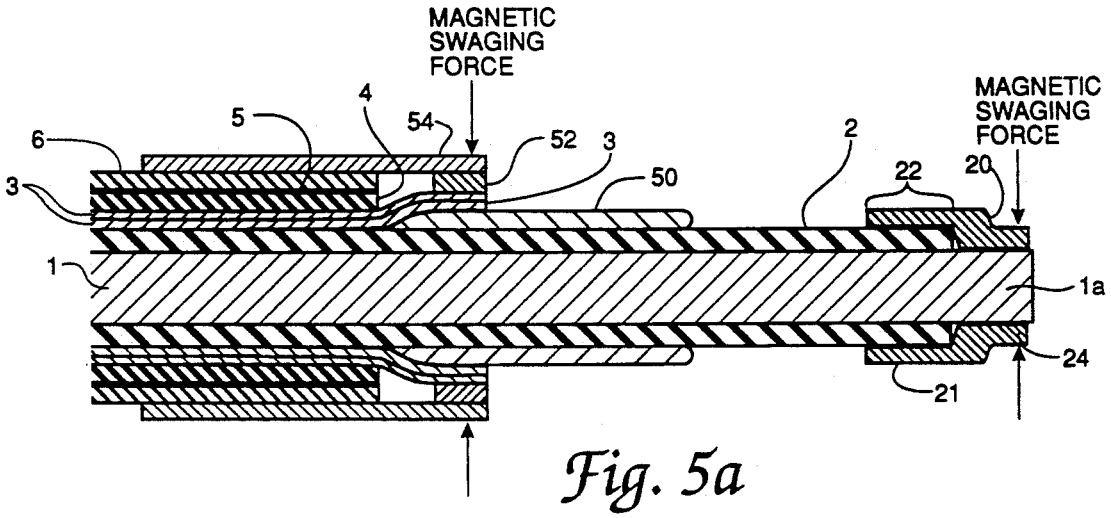
FIG. 5*a* shows magnetic swaging for both the center and outer conductors.

To assemble the outer conductor terminal connector, as shown in FIG. 5, a brass sleeve 50 is fitted under the outer conductor 3, which is then crimped in place with a copper crimp ring 52. A thin walled steel tube 54 is crimped over the copper ring 52 and the end of the outer cable jacket 6 for support and added mechanical strength. The mechanical force for the crimping is provided by use of the 8-jaw hydraulic powered swager. Note that the 2.2 inch portion of the brass sleeve 50 remains smooth. If the embodiment of FIG. 2 is used for the center conductor termination, the use of an intense pulsed magnetic force (magnetic swaging) applied over the crimp ring 52 deforms the conductor inward, as shown in FIG. 5*a*.

To assemble the center conductor terminal connector of FIG. 5, a right circular cylinder of UNS/C1100 copper is cut to a length of 1.3 inches and drilled to an inside diameter of 35/64 inch. The raw 2/0 gauge wire is inserted into the copper which is then swaged. The outside diameter of the copper decreases to less than one inch, the inside diameter decreases to less than 0.4 inches and the length increases to approximately one and a half inches. The copper cylinder is then cut with a 1"-8 UNC die for mating to an 1.125 inch UNS-C3300 brass sleeve 40 as shown in FIG. 5. The 0.125 inch wall thickness brass tube 40 is also threaded to 1"-8 UNC. The brass sleeve 40 is tightened with a strap wrench to insure good contact between the threaded pieces. A very light coating of "electronic joint compound" was applied to all surfaces which are in electrical contact.

Not shown in FIG. 5 is an insulating support sleeve (two inches in length, $\frac{7}{8}$" ID, $1\frac{1}{8}$" OD) which could be used to cover the exposed inner dielectric and provide additional strength to the cable end.

FIG. 6 shows the embodiment of FIG. 3 for the center conductor, plus a similar mechanically clamped termination using screws for the outer conductor. A copper connector 60 has screw holes drilled and tapped at the end. A copper clamping plate 64 has screw holes matching those of the connector 60. The outer conductor has the conductor bundles 3'b separated and flared to go between the end of the connector 60 and the plate 64. Contact force is provided by use of screws 66 to produce desired clamping force between two contact surfaces. The connector contact surface 61 remains smooth.

Fabrication Steps

The fabrication steps for the application of the cable end connectors for the embodiment of FIG. 5 are detailed in the following checklist.

| | |
|---|---|
| _a. | Cut cable to finished length. |
| _b. | Using a tubing cutter, cut through outer polyethylene jacket 6 and KEVLAR braid 5 at a point $6\frac{3}{4}$ inches from each end. |
| _c. | Using a utility knife, cut and remove outer jacket 6 and KEVLAR braid 5. |
| _d. | Cut and remove dielectric 4 between KEVLAR braid 5 and outer conductor 3. |
| _e. | Slide four inch long steel tube 54 over outer conductor 3 and onto outer jacket 6. |
| _f. | Slide copper crimp over outer conductor 3 up to outer jacket 6. |
| _g. | Slide brass sleeve 50 over inner dielectric 2 and under the outer conductor 3. |
| _h. | Tap the copper crimp ring 52 with a rawhide mallet while pushing the brass sleeve 50 toward the bulk of the cable. |
| _i. | Insure that the outer conductor wires are distributed uniformly between the brass sleeve 50 and copper crimp ring 52. |
| _j. | Adjust the position of the brass sleeve 50 to be 3.2 inches from the cut portion of the outer jacket 6. |
| _k | Position the copper crimp ring 52 to be 2.2 inches from the end of the brass sleeve 50. |
| _l. | Crimp the copper crimp ring 52 on to the outer conductor 3 using die set FT 1330-200-8 and a ram set of 980 on the crimping machine. The finished diameter of the copper ring 52 should be 1.345 ± 0.005 inches. |
| _m. | Trim excess length of the outer conductor 3 back to the copper crimp ring 52. |
| _n. | Slide the steel tube 54 forward until it is flush with the outer edge of the copper ring 52. Using the same die set as above, and a ram set of 840, crimp the steel tube 54 over the copper ring 52. Perform a second crimp to tighten the steel tube to the outer jacket 6. |
| _o. | Cut the inner dielectric 2 with a tubing cutter two inches from the end of the brass sleeve 50. Take care not to cut the inner dielectric 2. |
| _p. | Remove the section of inner dielectric 2 by twisting with pliers. |
| _q. | If an additional sleeve is required over the inner dielectric 2 it should be installed at this time. |
| _r. | Slide the copper end piece 10 over the center conductor 1 up to the cut portion of the inner dielectric 2. |
| _s. | Crimp the copper end piece 10 onto the center conductor 1 using die set FT 1330-200-4 with a ram set of 440. Recrimp as necessary to insure that the entire copper end is approximately round with a final diameter of 0.995 ± 0.005 inches. |
| _t. | Trim excess center conductor back to end of copper end piece 10. |
| _u. | Clamp copper end piece 10 in pipe vise leaving $1\frac{1}{8}$ inches free. |

-continued

| | |
|---|---|
| _v. | Cut at least eight full threads using a 1"-8 UNC die. |
| _w. | Apply a thin coating of electrical joint compound to the copper threads. |
| _x. | Screw on brass connector 40 and tighten with strap wrench |
| _y. | Remove all burrs with a fine file. |
| _z. | Repeat procedure on opposite end of cable. |

SCOPE OF THE INVENTION

Non-arcing contact between two conductors requires a contact pressure as described by Holm. Key elements in meeting the contact pressure criteria include minimizing pressure requirements through the use of good conductor materials such as copper or brass, using sufficiently thick conductor walls that pressure is maintained over a long lifetime, and providing mechanical support to the cable at end terminations. These criteria may be met using various materials and design configurations. Three such designs have been described herein.

It is understood that certain modifications to the invention as described may be made, as might occur to one with skill in the field of the invention, within the scope of the appended claims. Therefore, all embodiments contemplated hereunder which achieve the objects of the present invention have not been shown in complete detail. Other embodiments may be developed without departing from the scope of the appended claims.

What is claimed is:

1. A termination for a high energy coaxial cable having inner and outer conductors, with an inner layer of insulation between the inner and outer conductors, and an outer layer of insulation over the outside of the outer conductor, for use in pulsed high energy systems;

wherein the termination comprises:

a first connector means having a first outer surface and a first inner hole, the inner conductor being inserted into the first inner hole, means securing the first connector means to the inner conductor with sufficient force to meet a given resistance criterion; and a second connector means having a second outer surface and a second inner hole, the inner conductor together with the inner layer of insulation being inserted into the second inner hole, means securing the second connector means to the outer conductor with sufficient force to meet said given resistance criterion;

whereby the termination provides mechanical support to the cable at the termination, to prevent magnetic forces from moving the conductor in any direction which would loosen the contact;

the first outer surface and second outer surface each having a smooth, well-defined surface for interfacing with a mating system contact:

wherein said first connector means comprises a first part and a second part, with the first part having said first inner hole, which is cylindrical, the first part having been crimped and deformed to provide said means securing the first connector means to the inner con- ductor, the first part having threads on an outer surface which have been added to the part after being crimped, said second part being a cylindrical sleeve having threads on an inner surface to match the threads on the first part, the first and second parts being threaded together and torqued to high pressure, said first outer surface being an outer surface of the second part.

2. A termination according to claim 1, wherein said high energy coaxial cable further includes a braid layer over said outer layer of insulation and an outer jacket over the braid layer, wherein said second connector means comprises a brass sleeve, a copper crimp ring, and a thin wall steel tube;

wherein the brass sleeve has said second inner hole and has first and second portions, said second outer surface being an outer surface of the first portion;

wherein the copper crimp ring is placed around the second portion of the brass sleeve, with the outer conductor inserted between the second portion of the brass sleeve and the copper crimp ring;

wherein the thin wall steel tube has an inner cylindrical hole which encloses said outer jacket insulation and extends over the copper crimp ring;

the copper crimp ring, with the second portion of the brass sleeve and the portion of the thin wall steel tube which extends over the copper crimp ring having been crimped and deformed to provide said means securing the second connector means to the outer conductor.

3. A termination for a high energy coaxial cable having inner and outer conductors, with an inner layer of insulation between the inner and outer conductors, and an outer layer of insulation over the outside of the outer conductor, for use in pulsed high energy systems;

wherein the termination comprises:

a first connector means having a first outer surface and a first inner hole, the inner conductor being inserted into the first inner hole, means securing the first connector means to the inner conductor with sufficient force to meet a given resistance criterion; and a second connector means having a second outer surface and a second inner hole, the inner conductor together with the inner layer of insulation being inserted into the second inner hole, means securing the second connector means to the outer conductor with sufficient force to meet said given resistance criterion;

whereby the termination provides mechanical support to the cable at the termination, to prevent magnetic forces from moving the conductor in any direction which would loosen the contact;

the first outer surface and second outer surface each having a smooth, well-defined surface for interfacing with a mating system contact:

wherein said high energy coaxial cable further includes a braid layer over said outer layer of insulation and an outer jacket over the braid layer, wherein said second connector means comprises a brass sleeve, a copper crimp ring, and a thin wall steel tube;

wherein the brass sleeve has said second inner hole and has first and second portions, said second outer surface being an outer surface of the first portion;

wherein the copper crimp ring is placed around the second portion of the brass sleeve, with the outer conductor inserted between the second portion of the brass sleeve and the copper crimp ring;

wherein the thin wall steel tube has an inner cylindrical hole which encloses said outer jacket insulation and extends over the copper crimp ring;

the copper crimp ring, with the second portion of the brass sleeve and the portion of the thin wall steel tube which extends over the copper crimp ring having been crimped and deformed to provide said means securing the second connector means to the outer conductor.

4. A termination according to claim 3, wherein said first connector means comprises a first portion and a second portion with the first portion of the first connector means having a relatively small outside diameter compared to the second portion of the first connector means, the first portion of the first connector means having been crimped by a magnetic swaging force which deforms the first portion of the first connector means inward to provide said means securing the first connector means to the inner conductor, said first outer surface being an outer surface of the second portion of the first connector means which is unaffected by the swaging process and provides the smooth surface.

5. A termination according to claim 4, wherein said second portion of the first connector means has a counter bore to provide an insulator support region which fits over the inner layer of insulation.

6. A termination for a high energy coaxial cable having inner and outer conductors, with an inner layer of insulation between the inner and outer conductors, and an outer layer of insulation over the outside of the outer conductor, for use in pulsed high energy systems;

wherein the termination comprises:

a first connector means having a first outer surface and a first inner hole, the inner conductor being inserted into the first inner hole, means securing the first connector means to the inner conductor with sufficient force to meet a given resistance criterion; and a second connector means having a second outer surface and a second inner hole, the inner conductor together with the inner layer of insulation being inserted into the second inner hole, means securing the second connector means to the outer conductor with sufficient force to meet said given resistance criterion;

whereby the termination provides mechanical support to the cable at the termination, to prevent magnetic forces from moving the conductor in any direction which would loosen the contact;

the first outer surface and second outer surface each having a smooth, well-defined surface for interfacing with a mating system contact:

wherein said first connector means comprises a first part and a second part which are cylindrical with equal outer diameters, with the first part having said first inner hole, which is cylindrical, the first part having one flat end surface providing a contact surface, wherein the second part is a clamping plate with one flat end surface providing a contact surface;

wherein the inner conductor has wire bundles which are separated and flared between said contact surfaces of the first and second parts, wherein said means securing the first connector means to the inner conductor is provided by use of screws to produce a clamping force between said contact surfaces.

7. A termination according to claim 6, wherein said second connector means comprises a main part and a clamp part, with the main part having said second inner hole, the main part having first and second portions, with the first portion having said second outer surface, the second portion having a larger outer diameter than the first portion and a flat end surface providing a contact surface, the clamp part having an inner hole which fits over the outer layer of insulation and one flat end surface providing a contact surface;

wherein the outer conductor has wire bundles which are separated and flared between said contact surfaces of the main and clamp parts, wherein said means securing the second connector means to the outer conductor is provided by use of screws to produce a clamping force between said contact surfaces of the main and clamp parts.

8. In combination, a high energy coaxial cable for use in pulsed high energy systems and a termination therefor;

wherein said high energy coaxial cable comprises:

a center conductor comprising bundles of nickel plated fine copper wire, with bundles counter-wound in layers;

an outer conductor comprised of two counter-wound layers of stranded nickel plated fine copper wire, the cross-sectional area of the outer conductor being approximately equal to that of the inner conductor;

an inner dielectric between the center and outer conductors, the dielectric being of insulating materials capable of reliable operation to 260° C.;

an outer dielectric over the outer conductor for holding the outer conductor in place, the dielectric being of insulating materials capable of reliable operation to 260° C.;

a reinforcing mesh woven as a braid over the outer dielectric for aiding in the containment of magnetic burst forces, the mesh being manufactured from a high strength reinforcing material, with braid angles kept high for maximizing strength in the radial direction and maintaining tightness during manufacture; and an outer jacket made of insulating material; wherein the termination comprises:

a first connector means having a first outer surface and a first inner hole, the inner conductor being inserted into the first inner hole, means securing the first connector means to the inner conductor with sufficient force to meet a given resistance criterion;

a second connector means having a second outer surface and a second inner hole, the inner conductor together with the inner layer of insulation being inserted into the second inner hole, means securing the second connector means to the outer conductor with sufficient force to meet said given resistance criterion;

whereby the termination provides mechanical support to the cable at the termination, to prevent magnetic forces from moving the conductor in any direction which would loosen the contact;

the first outer surface and second outer surface each having a smooth, well-defined surface for interfacing with a mating system contact.

9. A combination according to claim 8, wherein said second connector means comprises a brass sleeve, a copper crimp ring, and a thin wall steel tube;

wherein the brass sleeve has said second inner hole and has first and second portions, said second outer surface being an outer surface of the first portion;

wherein the copper crimp ring is placed around the second portion of the brass sleeve, with the outer conductor inserted between the second portion of the brass sleeve and the copper crimp ring;

wherein the thin wall steel tube has an inner cylindrical hole which encloses said outer jacket insulation and extends over the copper crimp ring;

the copper crimp ring, with the second portion of the brass sleeve and the portion of the thin wall steel tube which extends over the copper crimp ring having been crimped and deformed to provide said means securing the second connector means to the outer conductor.

10. A method of fabricating end connectors for a high energy coaxial cable for use in pulsed high energy systems, wherein said cable comprises inner and outer conductors, with an inner layer of insulation between the inner and outer conductors, and an outer layer of insulation over the outside of the outer conductor, a braid layer over the outer layer of insulation and an outer jacket over the braid layer, wherein said end connectors have first and second connector means, wherein said first connector means comprises a copper end piece and a brass center connector, wherein said second connector means comprises a brass sleeve, a copper crimp ring, and a thin wall steel tube;

wherein said method comprises the steps:

a. cutting the cable to a finished length;

b. using a tubing cutter, cutting through the outer jacket and braid layer at a point a predetermined distance from the cable end;

c. using a utility knife, cutting and removing the outer jacket and braid layer;

d. cutting and removing the outer layer of insulation between the braid layer and the outer conductor;

e. sliding the steel tube over the outer conductor and onto the outer jacket;

f. sliding the copper crimp ring over the outer conductor up to the outer jacket;

g. sliding the brass sleeve over the inner layer of insulation and under the outer conductor;

h. tapping the copper crimp ring with a rawhide mallet while pushing the brass sleeve toward the bulk of the cable;

i. insuring that the outer conductor wires are distributed uniformly between the brass sleeve and the copper crimp ring;

j. adjusting the position of the brass sleeve to be a predetermined distance from the cut portion of the outer jacket;

k. positioning the copper crimp ring to be a predetermined distance from the end of the brass sleeve;

l. crimping the copper crimp ring on to the outer conductor using a given die set and a ram set of a given value on a crimping machine, with a predetermined finished diameter of the copper ring;

m. trimming excess length of the outer conductor back to the copper crimp ring;

n. sliding the steel tube forward until it is flush with the outer edge of the copper ring, then using the same die set as above, and a ram set of a given value, crimping the steel tube over the copper ring, and performing a second crimp to tighten the steel tube to the outer jacket;

o. cutting the inner layer of insulation with a tubing cutter a predetermined distance from the end of the brass sleeve, taking care not to cut the inner layer of insulation;

p. removing the section of the inner layer of insulation by twisting with pliers;

q. sliding the copper end piece over the center conductor up to the cut portion of the inner layer of insulation;

r. crimping the copper end piece onto the center conductor using a given die set with a ram set of a given value, recrimping as necessary to insure that the entire copper end is approximately round with a predetermined final diameter;

s. trimming excess center conductor back to the end of the copper end piece;

t. clamping the copper end piece in a pipe vice leaving a predetermined length free;

u. cutting at least eight full threads using a given die;

v. applying a thin coating of electrical joint compound to the copper threads;

w. screwing on the brass connector and tightening with a strap wrench; and x. removing all burrs with a fine file.

11. A termination for a high energy coaxial cable having inner and outer conductors, with an inner layer of insulation between the inner and outer conductors, and an outer layer of insulation over the outside of the outer conductor, for use in pulsed high energy systems;

wherein the termination comprises:

a first connector means having a first outer surface (21) and a first inner hole, the inner conductor being inserted into the first inner hole; wherein said first connector means comprises only one integral part (20) having a first portion and a second portion with the first portion having a relatively small outside diameter compared to the second portion, the first portion having been crimped by a magnetic swaging force which deforms the first portion inward to secure the first connector means to the inner conductor with sufficient force to meet a given resistance criterion, said first outer surface being an outer surface of the second portion which is unaffected by the swaging process and provides a smooth, well-defined surface for interfacing with a mating system contact; wherein said second portion has a counter bore to provide an insulator support region which fits over the inner layer of insulation;

a second connector means comprising a brass sleeve and a copper crimp ring, said brass sleeve having a second inner hole, the inner conductor together with the inner layer of insulation being inserted into the second inner hole, wherein the brass sleeve has first and second sections, with the first section having a smooth, well-defined outer surface for interfacing with a mating system contact; wherein the copper crimp ring is placed around the second section, with the outer conductor inserted between the second section of the brass sleeve and the copper crimp ring, the second section having been crimped by a magnetic swaging force which deforms the first portion inward to secure the first connector means to the inner conductor with sufficient force to meet said given resistance criterion, whereby the termination provides mechanical support to the cable at the termination, to prevent magnetic forces from moving the conductor in any direction which would loosen the contact.

12. A termination according to claim 13, wherein said high energy coaxial cable further includes a braid layer over said outer layer of insulation and an outer jacket over the braid layer, wherein said second connector means further comprises a thin wall steel tube;

wherein the thin wall steel tube has an inner cylindrical hole which encloses said outer jacket insulation and extends over the copper crimp ring;

the copper crimp ring, with the second section of the brass sleeve and a section of the thin wall steel tube which extends over the copper crimp ring having been crimped and deformed by a magnetic swaging force to secure the thin wall steel tube, along with the second section of the brass sleeve and the copper crimp ring, to the outer conductor.

* * * * *

UNITED STATES PATENT AND TRADEMARK OFFICE

CERTIFICATE OF CORRECTION

PATENT NO. : 5,154,637

DATED : October 13, 1992

INVENTOR(S) : Reja B. Klug et al

It is certified that error appears in the above-identified patent and that said Letters Patent is hereby corrected as shown below:

Column 12, line 64 (claim 12), "13" should be --11--.

Signed and Sealed this

Fifth Day of October, 1993

Bruce Lehman

*Attest:*

BRUCE LEHMAN

*Attesting Officer*

*Commissioner of Patents and Trademarks*